US005758875A

United States Patent [19]

Giacalone, Jr.

[11] Patent Number: 5,758,875

[45] Date of Patent: Jun. 2, 1998

[54] DYNAMIC RATE CONTROL METHOD AND APPARATUS FOR ELECTRONICALLY PLAYED GAMES AND GAMING MACHINES

[75] Inventor: Louis David Giacalone, Jr., Palo Alto, Calif.

[73] Assignee: Silicon Gaming, Inc., Saratoga, Calif.

[21] Appl. No.: 583,866

[22] Filed: Jan. 11, 1996

[51] Int. Cl.[6] ..... G07F 17/34

[52] U.S. Cl. ..... 273/143 R; 273/138.2; 463/20

[58] Field of Search ..... 463/1, 16–20, 463/23; 364/410, 412; 273/139, 143 R, 138.2

[56] References Cited

U.S. PATENT DOCUMENTS 4,299,388 11/1981 Resch et al. ..... 273/143 R
4,353,554 10/1982 Fisher ..... 273/143 R
4,373,727 2/1983 Hooker et al. ..... 273/143 R
4,430,903 2/1984 Hooker et al. ..... 273/143 R
5,472,197 12/1995 Gwiasda ..... 273/143 R

*Primary Examiner*—Jessica Harrison
*Assistant Examiner*—Mark A. Sager
*Attorney, Agent, or Firm*—Claude A. S. Hamrick

[57] ABSTRACT

A dynamic rate control method and apparatus for electronically played games and gaming devices and including an adaptable game play controller having a nominal play speed characteristic that is adjustable both up and down, together with means for sensing player input rate and for making stepped adjustments to the controller so as to cause the game play speed to follow the frequency of input by the player. The controller and sensing means can be implemented in either hardware or software, or a combination of hardware and software.

10 Claims, 2 Drawing Sheets

DYNAMIC RATE CONTROL METHOD AND APPARATUS FOR ELECTRONICALLY PLAYED GAMES AND GAMING MACHINES

BACKGROUND OF THE INVENTION

1. Field of the Invention

The present invention relates generally to electronically played games and gaming machines and, more particularly, to a method and apparatus for controlling the play rate of an electronic game as a function of the speed of player interaction with the machine running the game.

2. Brief Description of the Prior Art

Electronic games and gaming devices which respond to player input are well known and may take many forms, including card-type games, roulette-type games, and slot machines in which a number of reels are spun to generate an output having at least the appearance of chance. Devices of the latter type were originally mechanical devices, but have evolved from mechanical to electro mechanical and now to primarily electronic in nature. Taking the slot machine type game, known colloquially as the "one armed bandit", as an example of a gaming device that has survived the transition from mechanical to fully electronic, most implementations have involved either the actual or perceived spinning of wheels bearing indicia as a result of the pulling of a handle or pressing a play button which initiates the spinning of the reels. In the mechanical devices, the wheels typically spun at a generally constant initial speed, whether the rotation initiating force was produced through a strictly mechanical drive mechanism or from an electrical drive motor or solenoid-based drive mechanism. This meant that the initial speed of rotation or angular velocity that was imparted to the reels was generally the same for each pull of the handle, regardless of the speed with which the operating handle was pulled. Subsequently, in order to contribute to the feeling that the player was at least partially in control of the operation of the gaming device, a mechanical drive mechanism was provided that permitted the initial rotation to be varied in accordance with the speed with which the operating handle was pulled by the player. The initial rotation of the wheels, while being varied proportional to the speed with which the operating handle was pulled, occurred through the operation of a mechanical linkage that effectively transmitted the force applied to the handle to a shaft and then to the reels that were carried by the shaft.

This concept was later improved by providing electronic circuitry which effectively detected the speed of movement of the operating handle through its operating stroke and thereafter applied an electrical signal to an electrical motor means associated with the drive mechanism, with the strength of the driving signal being proportional to the detected speed, so as to vary the initial rotation that was imparted to the reels. The circuitry was also adapted to vary or alter the issuance of electrical signals that effectively caused the reels to be stopped, with the duration of the period of rotation or spin time for each reel varying in accordance with the detected speed of the pulling of the handle. Such apparatus is disclosed in U. S. Pat. No. 4,373,727 entitled "Variable Speed Gaming Device."

Although such apparatus was responsive to user input in that it controlled the speed of rotation of the reels, it also varied the wheel braking force in inverse proportion to the wheel spinning force, and thus did not materially change the effective playing speed of the game. More specifically, the time between user input and game result remained substantially the same. This is to say that although the user's "input" might have changed the play rate was not materially changed.

It has been observed, however, that where a player desires to play at a rate faster than the normal play rate, and his accelerated physical interaction, in inputting his money and making his selection or pulling a lever, has no effect on the play rate of the game, a degree of frustration sets in that interferes with his enjoyment of the game. There is thus a perceived need to make games of this type more interactive so that if one wants to play at a leisurely pace, the game will proceed at its normal play rate, but if the player's excitement level increases and he demonstrates a desire to play faster, the game play rate will be automatically increased. An even better circumstance might be that the machine's play rate tend to track (i.e., move up and down) in proportion to the rate of player input.

SUMMARY OF THE INVENTION

It is therefore a principal objective of the present invention to provide an adaptive control method and apparatus for use in association with electronic games and gaming machines such that the frequency of player input is detected and the game play time is changed to make it proportional to such input.

Another objective of the present invention is to provide gaming control apparatus which automatically adapts the game's speed of play to the frequency of player input.

Still another objective is provide a means for sensing the time between a particular gaming event and a subsequent player act and for using the measured time as a means by which to increase and/or decrease the play rate of the game.

Briefly, a preferred embodiment of the present invention includes the provision of an adaptable game play controller having a nominal play speed characteristic, which is adjustable both up and down, together with means for sensing player input rate and for causing the controller to make stepped adjustments of the game play speed to follow the frequency of input by the player. The controller and sensing means can be implemented in either hardware or software, or a combination of hardware and software.

An advantage of the present invention is that, since the game is caused to dynamically follow the input action of a player, it substantially delays the onset of boredom and allows the player to play the game at the frequency which is most comfortable to him. Moreover, by causing the game machine to adapt itself to player input, an enhanced sense of interaction between player and machine is created.

Another advantage of the present invention is that it increases the rate at which revenue can be generated for the proprietor of the machine, while at the same time creating the impression that the player will win more because he is, playing more.

These and other objects and advantages of the present invention will no doubt become apparent to those skilled in the art after having read the following detailed description of the preferred embodiment's illustrated in the drawing.

IN THE DRAWING

DESCRIPTION OF THE PREFERRED EMBODIMENTS

Figure 1:
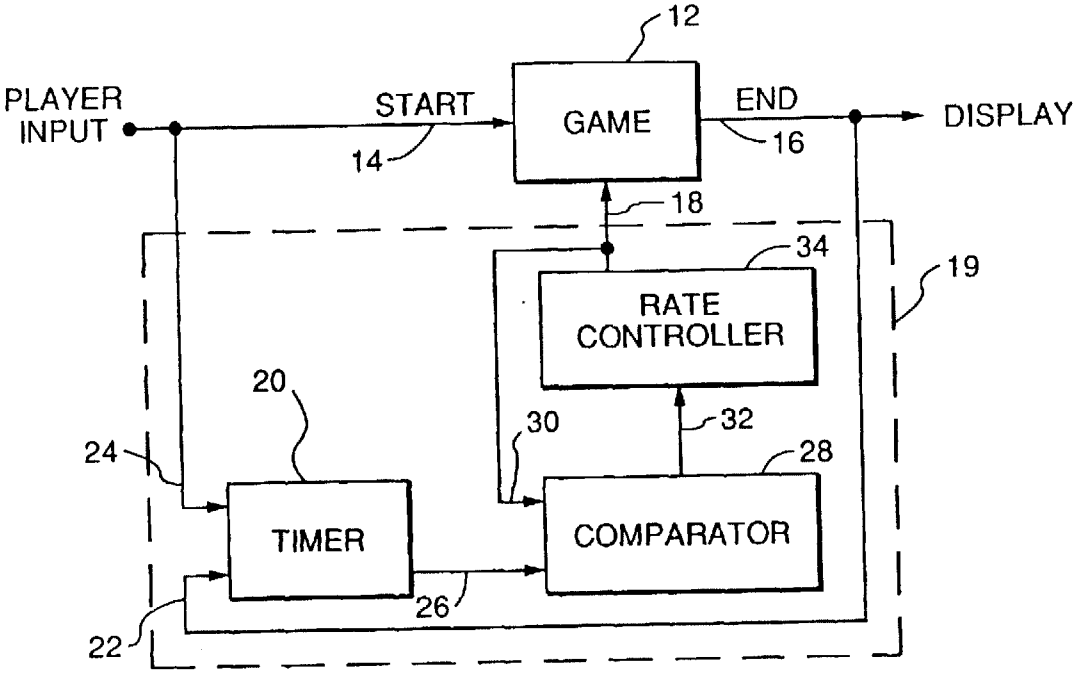
FIG. 1 is a block diagram schematically illustrating the principal function components of a play rate control system for a gaming machine.

Referring now to FIG. 1 of the drawing, an electronic play rate controlled gaming apparatus in accordance with the present invention is depicted in block diagram form at 10, and includes a computer controlled electronic gaming means 12 having an input 14 for receiving a "start" signal, an output terminal 16 at which an "end" of game signal is generated upon completion of play, and a control input 18 for receiving a play rate control signal. The adaptive controller 19 includes a timer 20 which measures the time between end and start signals, input thereto at 22 and 24, respectively, and generates a corresponding "interaction" signal at its output 26. A comparator 28 is used to compare the interaction signal on line 26 to a current "rate control" signal input at 30 and is operative to generate a rate adjust signal at its output 32. A rate controller 34 then responds to the rate adjust signal and generates the rate control signal on line 18.

In operation and upon start up, rate controller 34 will be initialized to develop a predetermined rate control signal at its output 18 that will correspond to what might be considered an average player interaction play rate. Upon input by a player of a start signal at 14, game 12 will be caused to play through its first cycle at the rate determined by the initial rate control signal and, upon conclusion of the game, will generate an end of game signal at 16. On receipt of the end signal at 22, timer 20 will start counting and terminate its count upon input of the next player start signal, at such time, generating at its output 26 an interaction signal which will be compared by comparator 28 to the current rate control signal applied to game 12. If comparator 28 senses a positive comparison, indicating that the player has input a start signal at a time earlier than the preset nominal time following the generation of the end of game signal, a play rate adjust signal will be generated at 32 which will cause rate controller 34 to generate a rate control signal tending to increase the rate of play of the game. Following generation of the next end of game signal, timer 20 will again compare the time of the end signal to the next start input and generate a second interaction signal. Comparator 28 will again compare the interaction signal to the current rate control signal and, depending upon the results of its comparison, generate a positive or negative adjust signal at 32 which in turn will cause rate controller to adjust its output up or down. Operation in this manner will then continue until the player either reaches a preset maximum play rate or a predetermined minimum play rate, in which case further adjustment in the same direction will be limited. It will thus be appreciated that the play rate of the game will be caused to automatically adapt to follow the speed of interaction of the particular player enjoying the game.

Figure 2:
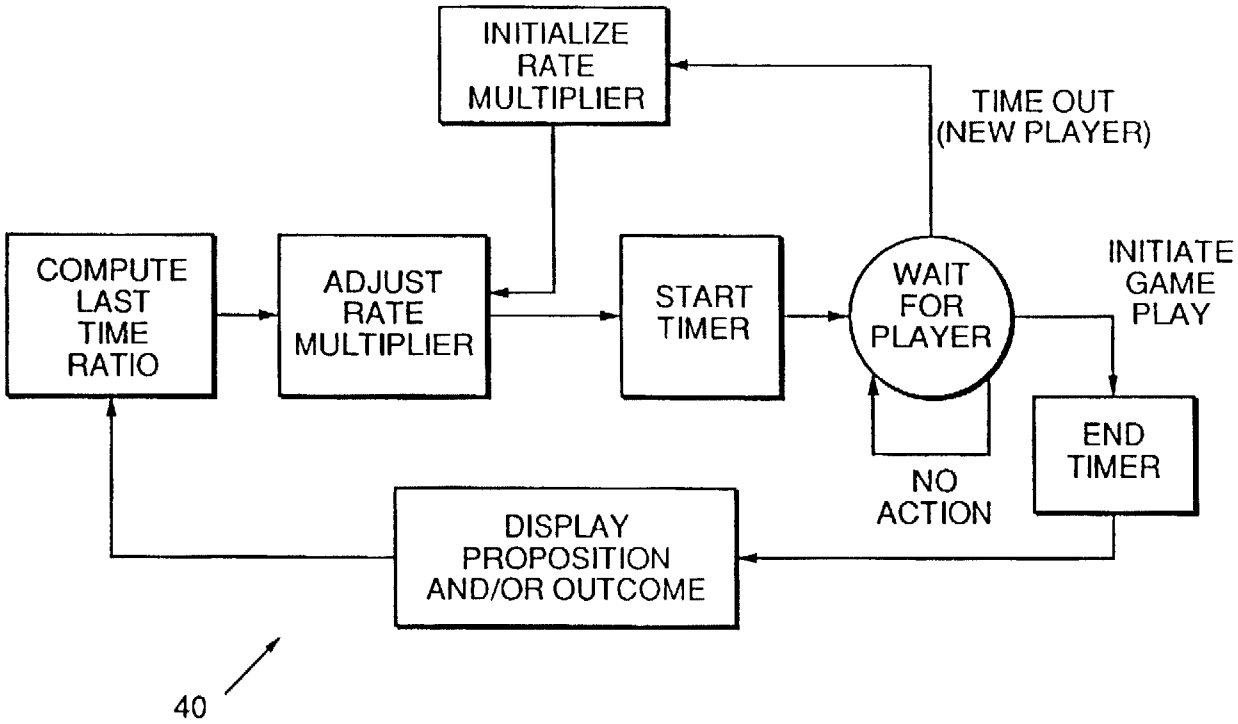
FIG. 2 is a diagram illustrating operation of a dynamic rate control method in accordance with the present invention.

Although illustrated in terms of hardware, it will be appreciated that the present invention can also be implemented as a software routine, as might be illustrated in block diagram form at 40 in FIG. 2. As shown in this diagram, the first step is to initialize the system variables upon game start by a new player. In response to a particular event, such as perhaps the start or end of the game, or an interim selection forming a part of the play sequence, a timing sequence will be commenced. The system will then enter a wait state, waiting for a user input. If no user input is received within a preset time, the system will "time-out" and re-initialize itself and await a new player input. If on the other hand, a player input is detected, the timing operation will end and the system will display the proposition and/or outcome of the count. At the end of the cycle, the outcome of the count will be used to compute the ratio of the last measured time interval to the correct time interval and the result will be used to update or adjust the rate multiplier used to control the play rate of the game.

The rate multiplier is a floating point number used to multiply first the nominal play rate term and thereafter, the previous cycle rate term so as to adaptively increment or decrement the play rate, in fractional steps, between predetermined maximum and minimum values depending upon the player's interaction with the gaming unit. The adjustments will be made as needed so long as the player continues to play the game.

It will be understood that whether implemented in hardware or software the result is the same; that is, the cycle time of game play will be automatically and adaptively changed to follow the rate at which the player interacts with the gaming device and enters a start signal. Such signal may be detected as the result of the mere deposit of a coin or chip, the making and entering of a play parameter selection, the pushing of a start button or switch of any type (including a heat sensing switch, a proximity switch, a capacitive switch, a mechanical switch, etc.), the touching of a touch-screen, the pulling of a lever, or the making of any other undetermined interactive act or overture, or combinations thereof, all of which are collectively referred to herein as "start signals". Similarly the game end signal is intended to mean a signal generated or as a result of any detectable event occurring during or at the completion of game play that can be used as a marker from which to measure player interactive response.

Although the present invention has been described above in terms of specific method and apparatus embodiments, it is anticipated that after reading this disclosure other implementations will present themselves to those skilled in the art. For example the present invention could be implemented as stand alone software for use in association with games played on a personal computer. In such case, the software would be adapted to run concurrently with and to interact with one or more particular applications so as to enhance the enjoyment of the game. It is therefore intended that the following claims be interpreted as covering all alternatives, alterations and modifications that fall within the true spirit and scope of the invention.

What is claimed is:

1. A gaming apparatus in which the frequency of player interaction is used as a basis upon which to adjust the play rate of the apparatus, said play rate being a function of the time difference between a player initiated generation of a game start signal and the generation of a game end signal, comprising:

an electronic game means having a player interface means for generating a game start signal in response to a player input, a control input for receiving a rate control signal, and means for generating a game end signal, said game means having a variable play rate determined by said rate control signal;

means for determining the difference in time between the generation of a game end signal and the generation of a subsequent game start signal, and for generating a player interaction signal proportional to said difference in time;

means for comparing said player interaction signal to a current rate control signal appearing at said control input and for generating a rate adjust signal commensurate with any difference therebetween; and game play rate control means responsive to said rate adjust signal and operative to generate an adjusted rate control signal for application to said control input, said adjusted rate control signal being used to adaptively control the play rate of said game means.

2. A gaming apparatus as recited in claim 1 wherein said game means is a slot machine and said interface means is selected from the group consisting of a pull handle, a push button, a switch, a touch-screen, and a coin actuator.

3. A gaming apparatus as recited in claim 1 wherein said play rate control means is operative to adaptively increment or decrement the play rate in fractional steps between predetermined maximum and minimum values depending upon the frequency of the player's interaction with the apparatus.

4. In a gaming apparatus including an electronic game playing means activated by a player initiated game start signal and evidencing game completion by the generation of a game end signal, and including rate selection means for selecting the play rate of the game, said play rate being defined as the time difference between the occurrence of a game start signal and the subsequent generation of a game end signal, an improved rate selection means wherein the play rate is selected as a function of the frequency of player interaction, comprising:

first means for determining the difference in time between the occurrence of a particular game generated event and the occurrence of a particular player interaction event, and for developing a player interaction signal proportional thereto; and second means responsive to said player interaction signal and operative to cause the play rate of said game playing means to be adoptively changed in proportion thereto.

5. In a gaming apparatus as recited in claim 4 wherein said rate selection means is controlled by a rate control signal, and wherein said second means includes:

third means for comparing said player interaction signal to a current rate control signal and for developing a rate adjust signal commensurate with any difference therebetween; and fourth means responsive to said rate adjust signal and operative to generate a rate control signal for controlling the play rate of said game playing means.

6. In gaming apparatus as recited in claim 5 wherein said game playing means is a slot machine and said start signal is generated by a player input selected from the group consisting of pulling a handle, pushing a button, touching a screen, actuating a switch, and depositing a coin.

7. In a gaming apparatus as recited in claim 5 wherein said rate control signal is operative to adaptively increment or decrement the play rate in fractional steps between predetermined maximum and minimum values depending upon the frequency of the player's interaction with the apparatus.

8. A method of adaptively controlling the play rate of an electronically played game in response to the frequency of player interactive input, said play rate being a function of the time difference between the generation of a player initiated game start signal and the generation of a game end signal, comprising the steps of:

sensing a functional or indicative event of the game and generating a first event signal;

sensing a player interactive event and generating a second event signal;

determining the elapsed time between the occurrence of said first event signal and said second event signal and developing a player interaction signal proportional thereto;

relating said player interaction signal to a first game control signal and generating a second game control signal commensurate with any difference therebetween; and using said second game control signal to change the play rate of said game.

9. A method as recited in claim 8 wherein said relating step includes:

comparing said player interaction signal to said first game control signal to develop a rate adjust signal commensurate with a difference therebetween; and using said rate adjust signal to generate said second game control signal.

10. A method as recited in claim 9 wherein said rate adjust signal can be either negative or positive in value so as to adjust said second control signal in steps to adaptively vary said play rate within a predetermined range between a maximum play rate and a minimum play rate.

* * * * *